US006498437B1

(12) United States Patent
Chang et al.

(10) Patent No.: US 6,498,437 B1
(45) Date of Patent: Dec. 24, 2002

(54) SHORT CIRCUIT PROTECTION FOR MULTIPLE LAMP LCD BACKLIGHT BALLASTS WITH PWM DIMMING

(75) Inventors: Chin Chang, Yorktown Heights, NY (US); Roderick T. Hinman, Natick, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 66 days.

(21) Appl. No.: 09/723,536

(22) Filed: Nov. 28, 2000

(51) Int. Cl.[7] ..... H05B 41/24

(52) U.S. Cl. ..... 315/141; 315/291; 315/119; 315/307; 315/362; 361/90; 361/93.6

(58) Field of Search ..... 315/141, 224, 315/291, 257, DIG. 4, 307, 319, 209 R, 119, 362; 361/90.1, 91.1, 90, 93.6

(56) References Cited

U.S. PATENT DOCUMENTS 4,613,792 A * 9/1986 Kroessler ..... 315/105
4,700,113 A * 10/1987 Stupp et al. ..... 315/208
5,949,197 A * 9/1999 Kastner ..... 315/291
5,973,437 A 10/1999 Gradzki et al. ..... 315/307
6,011,360 A 1/2000 Gradzki et al. ..... 315/244
6,359,391 B1 * 3/2002 Li ..... 315/119

* cited by examiner

*Primary Examiner*—Don Wong
*Assistant Examiner*—Ephrem Alemu

(57) ABSTRACT

A lamp ballast for energizing a lamp has short circuit protection. The lamp ballast contains a transformer that provides an output voltage to the lamp. The transformer has a primary winding, a secondary winding, and a third sense winding. The third sense winding has an output that provides an indication of transformer output voltage. A reference voltage circuit creates a reference voltage that provides an indication of a non-short circuited lamp ballast condition. A comparator compares the reference voltage and the output of the third sense winding to provide an indication if the third sense winding output is below the reference. This indicates if there is a short in the output of the lamp ballast. The secondary is wound on multiple sections of a bobbin with one section being a low voltage section. The sense winding is wound under the secondary in the bobbin secondary low voltage section. The ballast additionally has a track and hold circuit to prevent an indication of a short in the lamp voltage when the lamp voltage is dimmed with a dimming circuit. The ballast also has a preheat logic signal to prevent a short circuit indication during the preheat mode at startup.

20 Claims, 9 Drawing Sheets

SHORT CIRCUIT PROTECTION FOR MULTIPLE LAMP LCD BACKLIGHT BALLASTS WITH PWM DIMMING

BACKGROUND OF INVENTION

1. Field of the Invention

The invention relates to a ballast for driving multiple lamps in a liquid crystal display (LCD). More specifically, the invention relates to a method for sensing a short circuit condition in the ballast transformers outputs to the multiple lamps.

2. Description of the Related Art

In some lamp ballasts, it is desirable to sense a short circuit condition on the output and take an action. This action could be to reduce the power level or shut down entirely in order to avoid circuit breakdown or other possible catastrophic situations. The conventional method to achieve this is to sense the current in the output (hence the lamp current) and compare to a threshold. When the reference level is exceeded, the action can be taken. This current sensing can be implemented in several ways, for instance by inserting a resistor in series with the load and sensing the voltage drop across it.

A difficulty with the state of the art is that it requires a measurement of current. It may be undesirable because the sensing resistor dissipates too much power. It may also be difficult if the circuit inherently limits the current to the load. An example would be an LCD backlight inverter based on the Alpha IC (UBA2010). The secondary winding of the transformers has enough leakage inductance that its impedance limits the current if the load is shorted. The circuit is self protecting, but one may still wish to sense the shorted condition and shut down for safety reasons.

What is needed is a ballast where a short circuit condition is sensed by a method other than measuring lamp (load) current or output voltage directly.

SUMMARY OF THE INVENTION

The invention is a lamp ballast for energizing a lamp which has a new method for sensing a short circuit condition. The lamp ballast has a transformer that provides an output voltage to the lamp. The transformer has a primary winding, a secondary winding, and a third sense winding. The third winding has an output which provides an indication of transformer output voltage. A reference voltage circuit creates a reference voltage providing an indication of a non-short circuited lamp ballast condition. A comparator compares the reference voltage and the output of the third sense winding. The comparator provides an indication if the third sense winding output voltage is below the reference voltage thus indicating a short in the output of the lamp ballast.

The method of winding the transformer improves the third sense winding output voltage signal. The transformer is wound on a bobbin with multiple sections. The transformer secondary is wound on multiple sections of the bobbin with one section being a low voltage section. The sense winding is wound under the secondary in the bobbin secondary low voltage section.

Several circuits are necessary to implement the above circuit for indicating a short in the output of the lamp ballast. First, the ballast has a dimming circuit during which time the lamp voltage is reduced substantially. The ballast has a track and hold circuit which cooperates with the voltage of the sense winding at the comparator to hold the voltage above the reference voltage so as to prevent an indication of a short in the lamp voltage.

Secondly, during startup the transformer output is zero and would have an indication of a short circuit. A special circuit is provided to delay any indication of a short circuit until the lamp ballast circuit is powered up. During startup the sense winding voltage at the comparator gradually increases during a preheat mode. A preheat logic signal applies a low voltage to the reference voltage circuit during the preheat mode. This prevents the reference voltage from exceeding the sense winding voltage thus preventing a short circuit indication during the preheat mode.

DETAILED DESCRIPTION OF THE INVENTION

Figure 1:
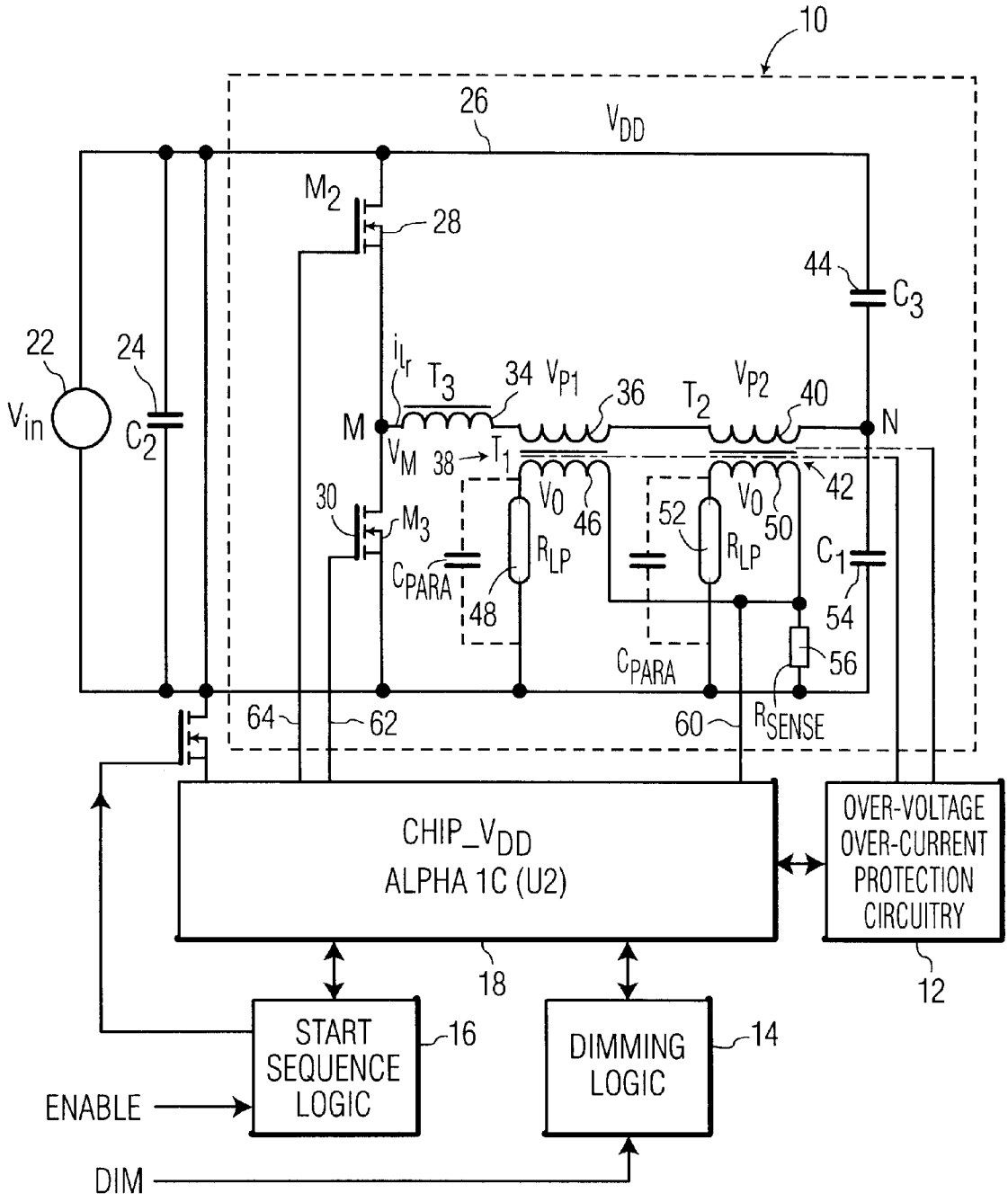
FIG. 1 shows a schematic drawing of an LCD backlight inverter with a series structure and short circuit protection.

FIG. 1 shows a block diagram of short circuit protection for a liquid crystal display (LCD) backlight ballast with PWM dimming. Element 10 shows a prior art liquid crystal display (LCD) backlight inverter with a series structure. In this structure, one inverter is used to power two Cold Cathode Fluorescent Lamps (CCFL). Over voltage, over-current protection circuitry 12 is the basis for the present invention and provides a means for sensing a short circuit in the CCFL lamps by sensing transformer voltage instead of lamp current or output voltage directly. Dimming Logic 14 is for dimming the LCD display in cooperation with the overvoltage protection circuit. Start sequence logic 16 is for enabling the LCD display in cooperation with the overvoltage protection circuit. Control integrated circuit 18, (Alpha IC(U2)), is a state of the art control IC (model UBA 2010) which controls the functions and timing of LCD backlight inverter 10, over voltage, over-current protection circuitry 12, dimming logic 14 and sequence logic 16. Power is provided to the circuit by a voltage source Vin (22) connected across capacitor C2 (24) to provide a VDD (26) to power the inverter circuit.

In prior art liquid crystal display (LCD) backlight inverter 10, control integrated circuit (IC) (18) controls switches M2

(28) and M3 (30) which are connected across capacitor C2 (24). When switch M2 (28) is closed, switch M3 (30) is open and the opposite is true when switch M2 (28) is open. Inductor T3 (34) has one terminal connected to a common terminal of switches M2 (28) and M3 (30) and the other terminal to primary (36) of transformer T1 (38) which is connected in series to primary (40) of transformer T2 (42). The other terminal of primary (40) is connected to one terminal of capacitor C3 (44) which has its other terminal connected to VDD (26). The secondary (46) of transformer T1 (38) has one terminal connected to lamp (48) and the other terminal to ground. The secondary (50) of transformer T2 (42) has one terminal connected to lamp (52) and the other terminal to ground. Capacitor C1 (54) has one terminal connected to capacitor C3 (44) and the other terminal connected to ground. Sense resistor Rsense (56) has one terminal connected to transformer secondaries (46) and (50) and the other terminal connected to ground. Sense resistor Rsense (56) is used to sense the current in secondaries (46) and (50), respectively. The sensed voltage across Rsense (56) current is provided to control IC (18) through line (60). Control IC (18) also provides control lines (62) and (64) to switches M3 (30) and M2 (28), respectively, to open or close the switches so that one switch is on while the other switch is off and vice versa.

In operation, external voltage source Vin (22) provides a voltage across capacitor C2 (24) which builds up to a voltage VDD (26). To backlight the LCD screen, control IC (18) provides a control signal on control line (64) to turn on switch M2 (28). This creates one-half VDD (26) between points N and M along with a voltage divider circuit made up of capacitor C3 (44) and C1 (54). Inductor T3 (34) and transformer primaries (36), (40) have one-half VDD applied across them between points N and M. Transformer primaries (36), (40) provide the signal applied to transformer secondaries (46) and (50) to drive lamps (48) and (52) respectively. In the second half of the high frequency switching cycle, the control signal from control IC (18) is applied to switch M3 (30) to turn it on. At the same time switch M2 (28) is turned off. Sense resistor Rsense (56) is used to sense the current in secondaries (46) and (50), and provide that information to control IC (18) through lines (60).

Figure 2:
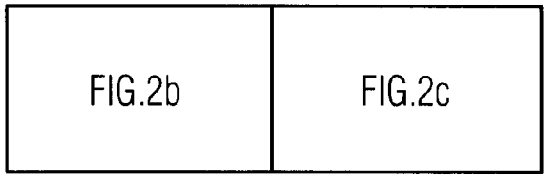
FIG. 2 shows a block diagram of the LCD backlight inverter with short circuit protection of FIG. 1.
Figure 2A:
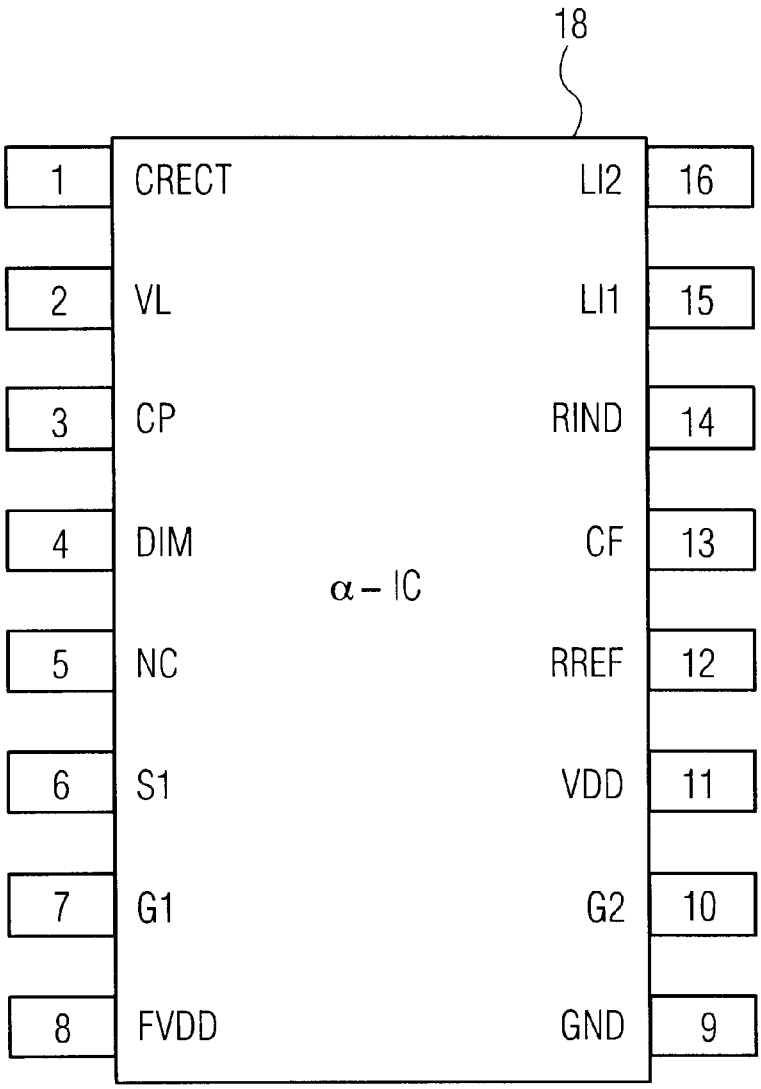
FIG. 2*a* shows an enlarged view of the pinout of the Alpha IC U2 from FIG. 2.
Figure 2B:
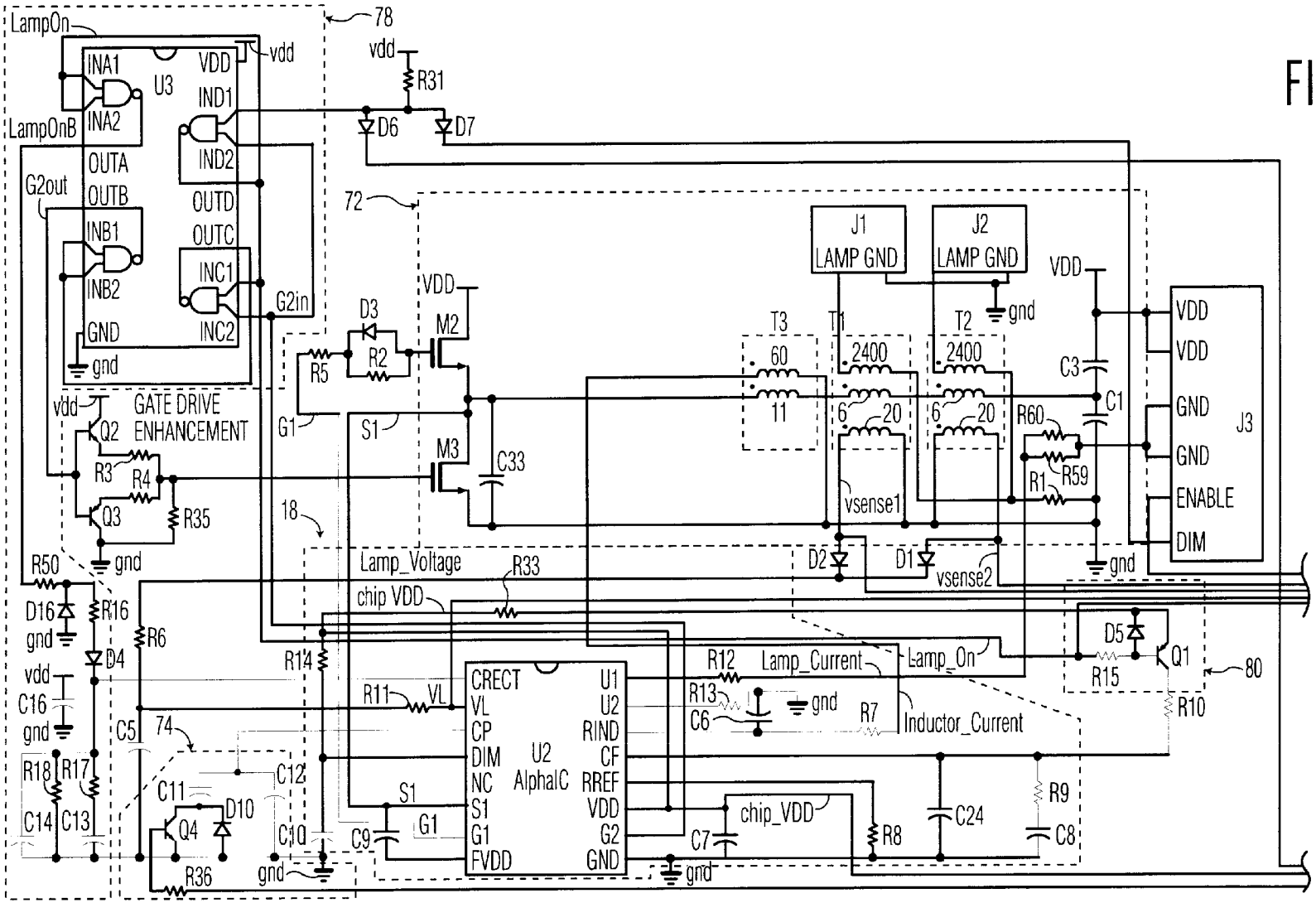
FIG. 2*b* shows a detailed schematic drawing of one embodiment of a block FIG. 2*b* as shown in FIG. 2.
Figure 2C:
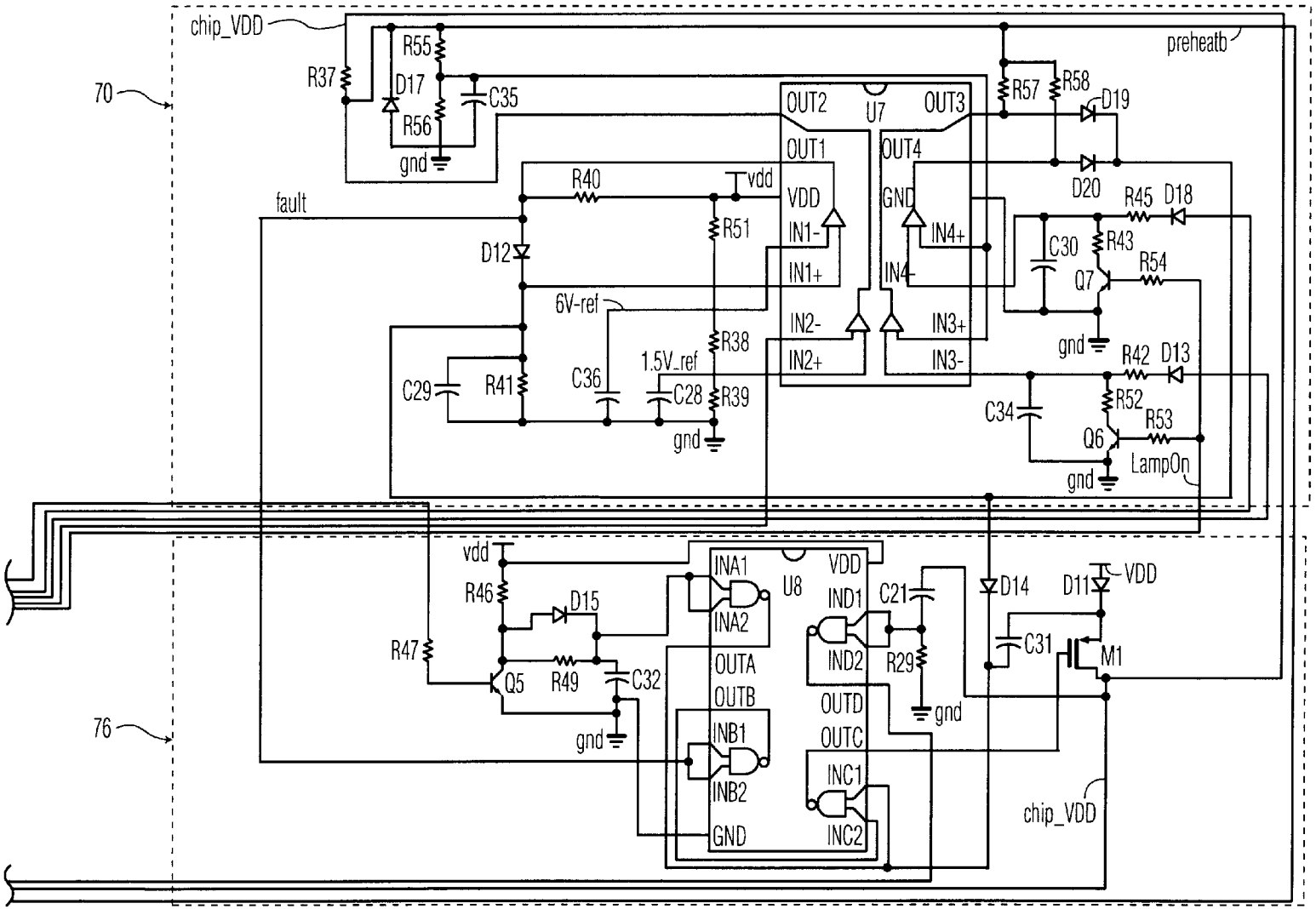
FIG. 2*c* shows a detailed schematic drawing of one embodiment of a block FIG. 2*c* as shown in FIG. 2.

FIGS. 2*b* and 2*c* illustrate a detailed schematic showing the circuitry of each of the blocks of FIG. 1. Over voltage, over-current protection circuitry 12 and liquid crystal display (LCD) backlight inverter 10 shown in FIG. 1 are shown in detail in blocks 70 and 72, respectively, in FIGS. 2*b* and 2*c*, and contain the circuitry which forms the basis of the invention. Both of these blocks will be described in extensive detail. Start-up sequencing logic 16 shown in FIG. 1 is made up of blocks 74 and 76 in FIGS. 2*b* and 2*c*, respectively. The circuitry shown in these blocks cooperates with the short circuit protection circuit. PWM dimming logic 14 shown in FIG. 1 is made up of blocks 78 and 80 in FIG. 2*b*. The circuitry shown in these blocks which cooperates with the short circuit protection circuit. Control integrated circuit 18, Alpha IC(U2), shown in FIG. 1 is shown in detail in FIG. 2*b*. FIG. 2*a* shows an enlarged view of the pinout of the Alpha IC U2. This circuit is known in the art and provides control and timing to the LCD backlight inverter.

Figure 3A:
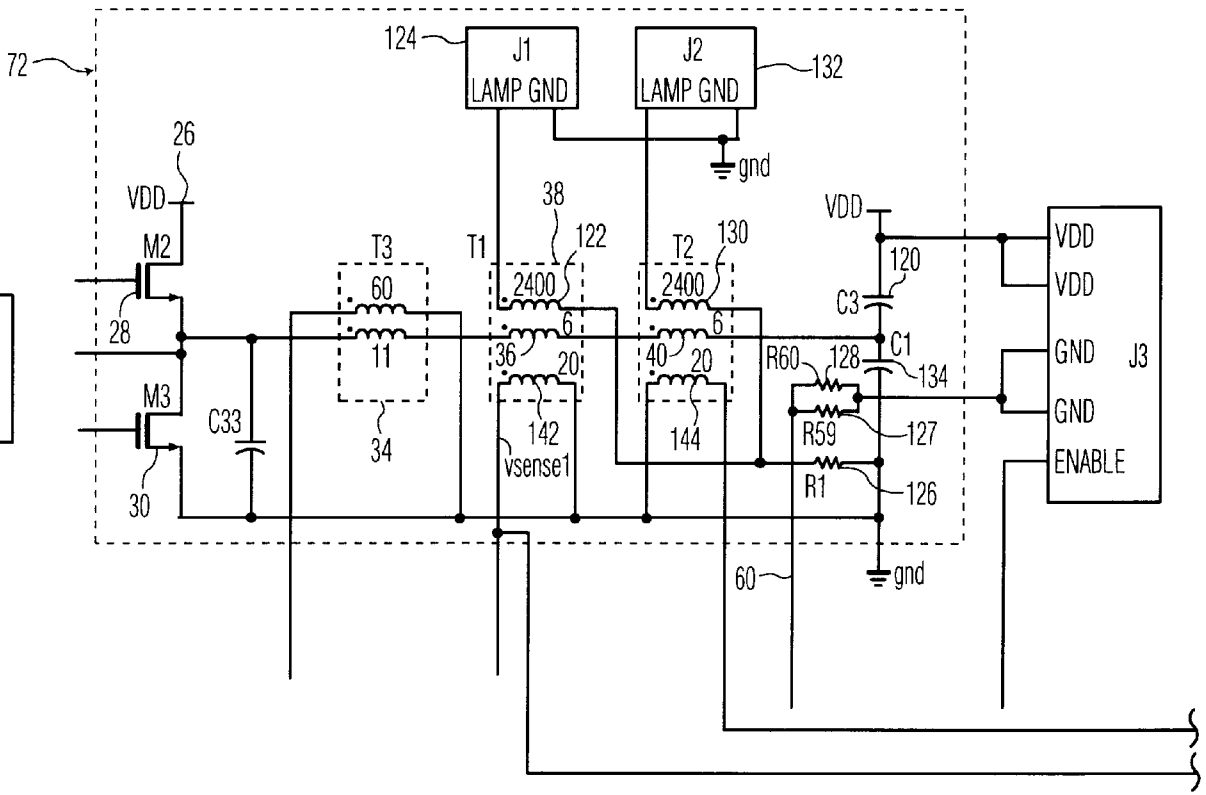
FIG. 3*a* shows a detailed schematic drawing of one embodiment of a block FIG. 3*a* as shown in FIG. 3.
Figure 3:
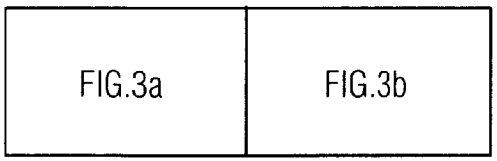
FIG. 3 shows block diagram of the LCD backlight inverter with short circuit protection of FIG. 2.
Figure 3B:
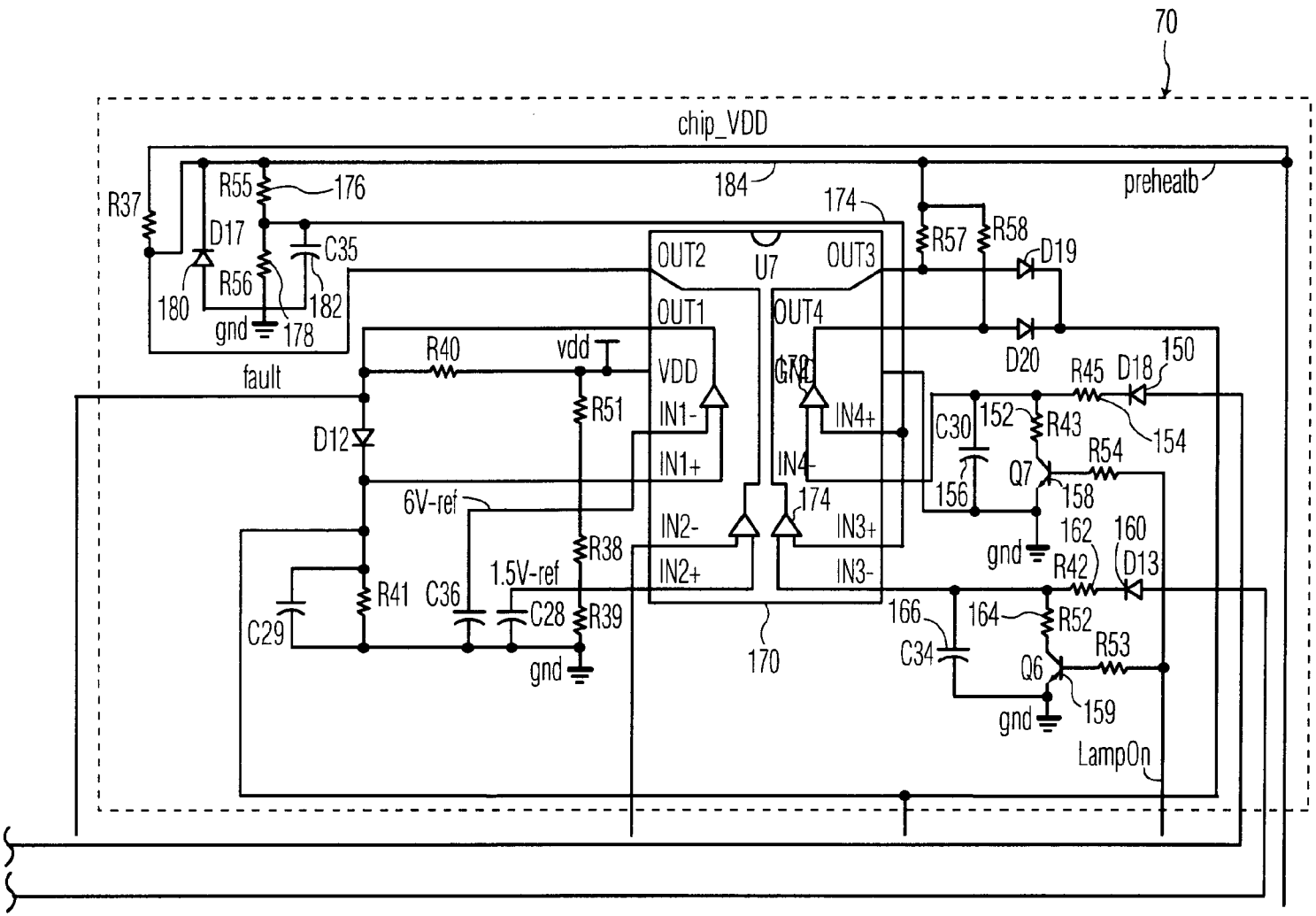
FIG. 3*b* shows a detailed schematic drawing of one embodiment of a block FIG. 3*b* as shown in FIG. 3.

FIGS. 3A and 3B shows an enlarged view of over voltage, over-current protection circuitry (70) and liquid crystal display (LCD) backlight inverter (72). Looking first at backlight inverter (72), VDD (26) represents the same VDD as in FIG. 1 and powers the backlight inverter circuit. Control integrated circuit (18)(shown in FIG. 2*b*) controls switches M2 (28) and M3 (30). These switches are connected across VDD 26. When switch M2 (28) is closed, switch M3 (30) is open and the opposite is true when switch M2 (28) is open. Inductor T3 (34) has one terminal connected to a common terminal of switches M2 (28) and M3 (30) and the other terminal to primary (36) of transformer T1 (38) which is connected in series to primary (40) of transformer T2 (42). Transformers T1 (38) and T2 (42) are shown in more detail in FIG. 3*a* and contain the sensing elements (142) and (144) which are part of the invention.

The other terminal of primary (40) is connected to one terminal of capacitor C3 (120) which has its other terminal connected to VDD (26). The secondary (122) of transformer T1 (38) has one terminal connected to lamp J1 (124) and the other terminal to sense resistor R1 (126) and then to ground. The secondary (130) of transformer T2 (42) has one terminal connected to lamp (132) and the other terminal to sense resistors R1 (126), R59 (127), R60 (128) and then to ground. Capacitor C1 (134) has one terminal connected to capacitor C3 (120) and the other terminal connected to ground. Sense resistors R1 (126), R59 (127), R60 (128) are used to sense the current in secondaries (122) and (130), respectively. The sensed voltage across Rsense including R1 (126), R59 (127), R60 (128) is provided to control IC (18)(shown in FIG.2) through line (60).

The power stage 72 is a half bridge having resonant inductor T3 (34) and transformers T1 (38) and T2 (42). The transformer primary windings are in series, and connect to the split buffer capacitors C1 (134) and C3 (120). Note that there is no explicit resonant capacitor. However, the parasitic capacitors of the shield and the transformers are significant due to the large output transformer turns ratio. In fact, depending upon the LCD panel construction and turns ratio, the equivalent primary capacitance can reach 1 $\mu$F. This capacitance is the resonant element that creates the high voltage. The Q factor and therefore the reactive power have been kept to a minimum in the resonant tank by not adding an explicit capacitor. The current in the inductor and switches is lower than in a high Q system.

The over-voltage, over-current protection circuitry 70 enlarged in FIGS. 3A and 3B includes a number of inventive circuits which solve problems associated with sensing a short circuit condition in the transformers T1 (38) and T2 (42).

The first advancement of the invention is to sense a short circuit condition by sensing transformer voltage instead of lamp (load) current or output voltage directly. This is accomplished by sensing the voltage of the third sense winding (142) and (144) on the transformers T1 (38) and T2 (42).

One challenge of the implementation of the first advancement is that dimming of the lamps is implemented by periodically turning off the oscillations in the power stage with the circuitry in PWM Dimming Block 78 and extinguishing the lamps. During that time, the voltage of lamps J1 (124) and J2 (132) and transformers T1(38) and T2 (42) goes to zero and without further modification the zero voltage output of the third sense windings 142, 144 would be interpreted as a shorted lamp. The second innovation of the invention is to create a track and hold circuit for the filtered lamp third sense winding voltage, so no indication of zero voltage is given during dimming.

The third innovation involves the initial startup of the inverter when the lamp voltage is zero. The third innovation prevents a short circuit signal from occurring while the lamp voltage is less than a threshold signal indicating a short circuit.

A fourth innovation is a method of winding the third sense winding on the transformer that improves the signal sensed.

Looking at the first advancement of the invention, a short circuit condition is detected by sensing transformer voltage instead of lamp (load) current or output voltage directly. A representation of the lamp voltage is sensed by third sense windings (142) and (144) of transformers T1 (38) and T2 (42) shown in backlight inverter (72). The sensing continues for both third windings (142) and (144) while the lamp circuits J1 (124) and J2 (132) reach their steady state operating modes. Over-voltage, over-current protection circuitry 70 shows a circuit to rectify and filter each of the sense winding voltages and compare them to a threshold which indicates if a short circuit condition is occurring. In the upper right hand of the schematic corner, the components labeled D18 (150), R43 (152), R45 (154), and C30 (156) rectify and filter the winding voltage from transformer T2 (42), while D13 (160), R42 (162), R52 (164), and C34 (166) do the same for the other transformer T1 (38). A comparison is made with a reference or threshold level voltage in IC U7 (170) in comparators (172) and (174) respectively. The threshold setting indicates when a short circuit has occurred. The threshold setting circuit consists of R55 (176), R56 (178), D17 (180), and C35 (182).

One challenge of this implementation is that dimming of the lamps J1 (124) and J2 (132) is implemented by periodically turning off the oscillations in the power stage and extinguishing the lamps. The oscillator is made up of R8, C24, C8, R9 (shown in FIG. 2*b*) connected to the DIM pin in control IC 18. During that time, the lamp voltage goes to zero and without further modification the voltage sensing circuit, including third windings (142) and (144), would interpret the zero voltage as a shorted lamp. A second innovation of the invention is to create a track and hold circuit for the filtered lamp voltage so it will not go to zero during dimming. Switches, such as transistors Q7 (158) and Q6 (159), are placed in series with the filter resistors R43 (152) and R52 (164) respectively so that there is no DC current path from the filter capacitor to ground. During oscillation, switchs Q7 (158) and Q6 (159) are on, and the filters operate normally. When the oscillation is interrupted, the switches Q7 and Q6 are off, and the capacitors C30 and C34 hold their voltage. Since the voltage does not decay, an erroneous short circuit signal is avoided. When oscillation resumes, the capacitor voltages are already at their proper value, and circuit operation begins exactly where it left off.

When the backlight inverter initially starts up, the lamp and third windings (142) and (144) voltages are zero. A third innovation prevents a short circuit signal from occurring while the lamps and third windings (142) and (144) voltages are less than the threshold level (174) established by threshold setting circuit consisting of R55 (176), R56 (178), D17 (180), and C35 (182). This resistive divider is connected to a logic signal instead of a fixed power supply voltage. This logic signal, "preheatb" (184) is zero volts during the time the control IC (18)(shown in FIG.2) is in preheat mode, and rises to the zener voltage of D17 (180) when the preheat mode ends.

Figure 4:
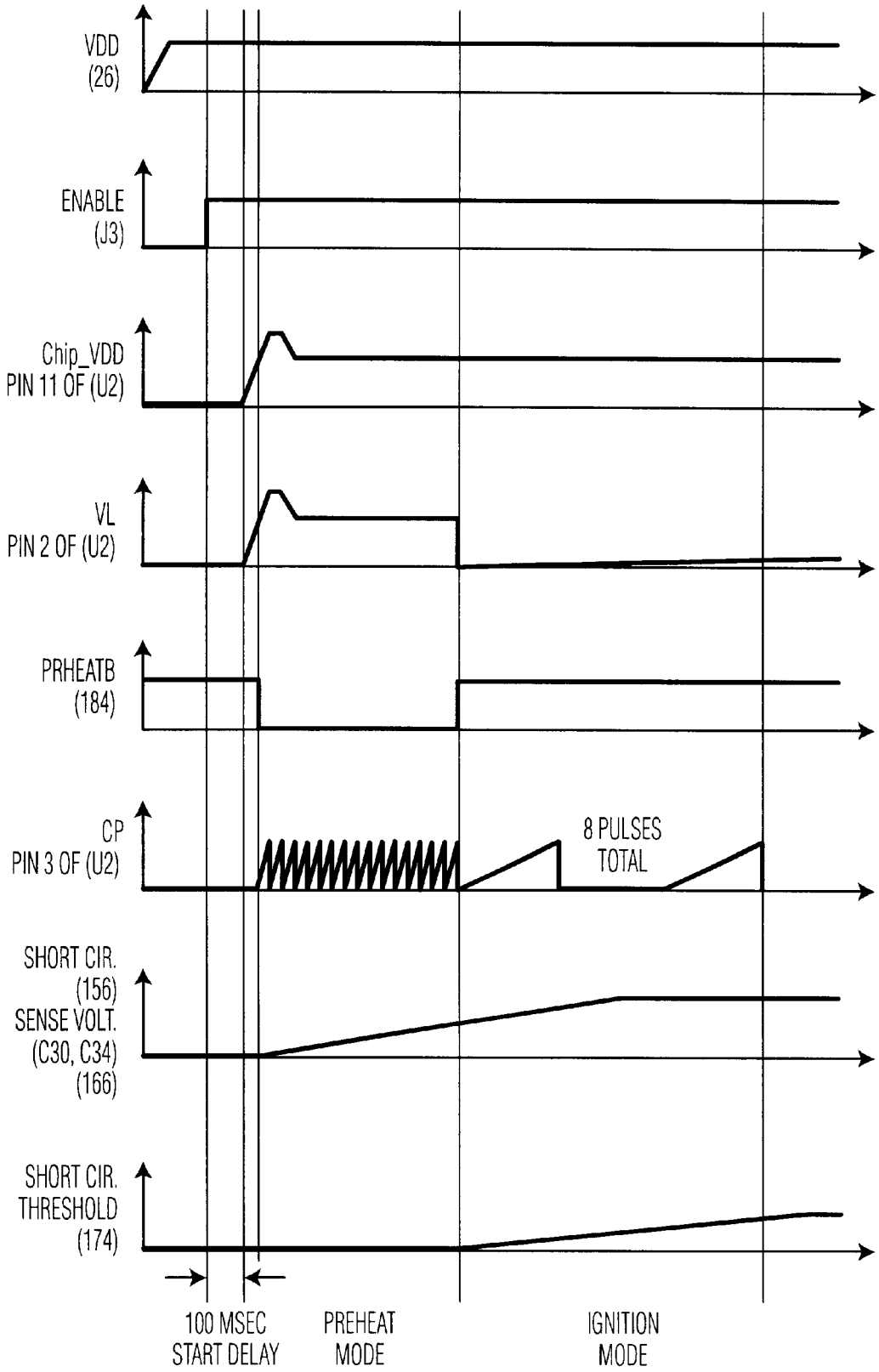
FIG. 4 is a signal vs time chart for the various signals involved with the circuit for startup, preheating and prevention of a short circuit indication for the lamp during startup.

Startup waveforms of this circuit are shown in FIG. 4. The power circuit oscillates during preheat mode, so voltage builds up upon C30 (156) and C34 (166). At the end of preheat mode, the C30 (156) and C34 (166) voltages are greater than the threshold (174), and continue to rise as the control IC (18) attempts to ignite the lamp. The threshold voltage (174) also rises during ignition, but the presence of C35 (182) slows its rise. Therefore we are assured that the short circuit sensing voltages C30 (156) and C34 (166) are always greater than their threshold level (174), and the circuit starts properly. FIG. 4 shows the complete operation of the circuit during startup, although the time axis is not to scale. The power supply VDD (FIG. 1) rises to 12V when the user plugs in the unit and turns on the power supply. When the ENABLE signal (J3 in FIG. 2) is raised to true (5V) by the user or after 100 msec delay, a charge pump circuit turns on chip_VDD (from the source of M1 in block 76) and boosts it above 12V. The VL pin of the control IC 18 follows chip_VDD. When VL crosses 1.5V, U7 pulls preheatb (184) low. When chip_VDD crosses the startup voltage of the undervoltage lockput circuit (about 11.5), oscillation of the power circuit begins, and the preheat and protection circuit of the control IC 18 begins to oscillate and count triangular pulses at the CP node. During the preheat period voltage builds up across the lamps and the sensing circuits for short circuit protection also build up voltage. The preheat mode ends after 16 pulses at CP. A this time, the VL node drops and remains less than 1 V during ignition and normal operation of the lamp. The preheatb signal goes high, turning on Q4 and increasing the CP capacitance. The ignition period lasts 8 CP pulses, each much longer than before due to the increased capacitance. When preheatb goes high, the threshold voltage for short circuit protection is released from zero and begins to charge. It always remains less than the sensed voltages (unless there is a short circuit). If the lamp has not ignited at the end of the ignition period, the control IC 18 latches in standby mode.

Figure 5A:
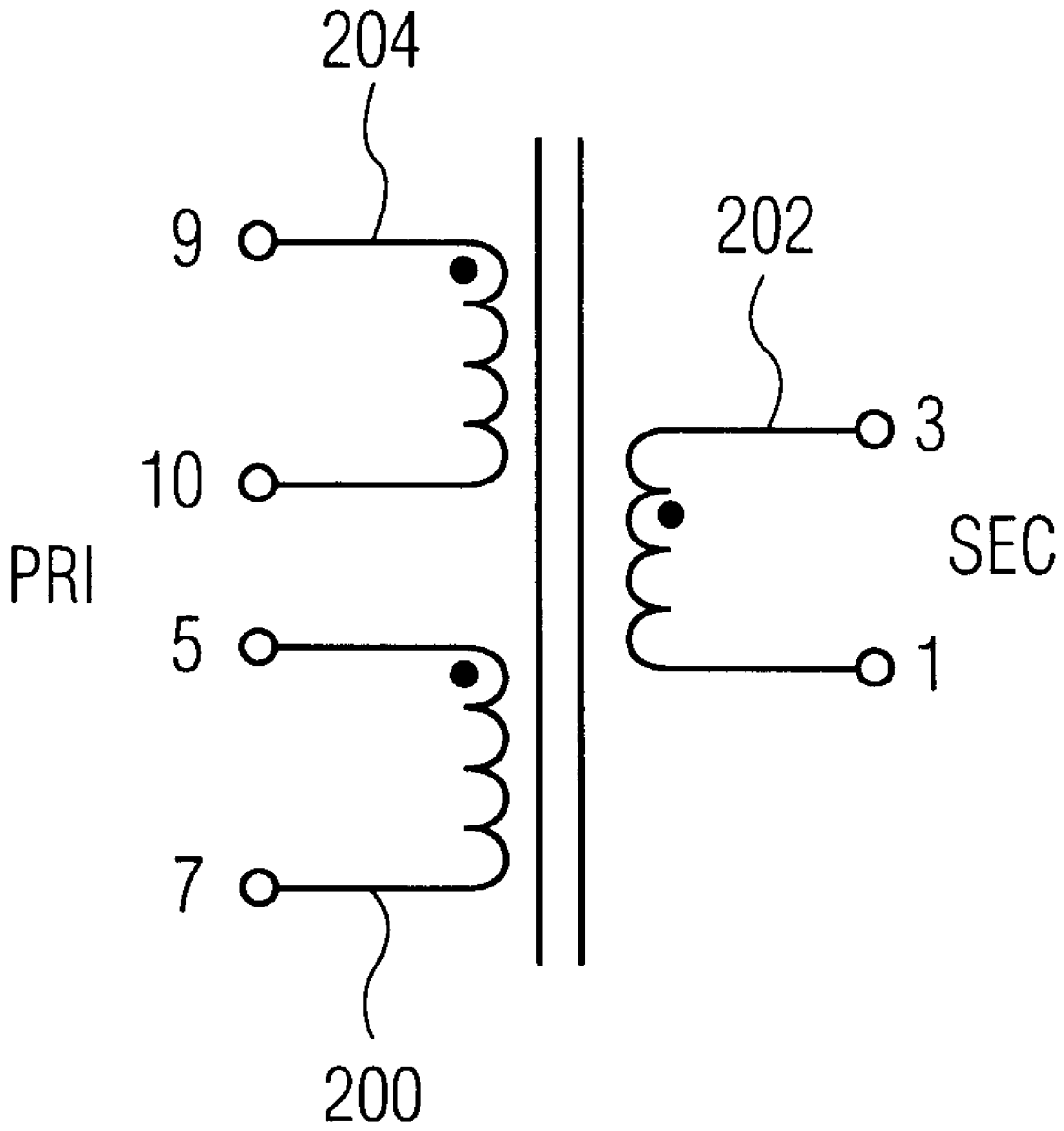
FIG. 5*a* is a schematic of the primary, secondary and sense windings of the transformers.

A fourth innovation is a method of winding transformers T1 (38) and T2 (42) that improves the signal from third sense windings (142) and (144). A schematic for the windings of transformers T1 (38) and T2 (42) is shown in FIG. 5*a*. The primary winding is labeled 5-7 (200), the secondary is labeled 3-1 (202), and the sense winding is labeled 9-10 (204). A schematic of the bobbin on which each of transformers Ti and T2 are wound is shown in FIG. 5*b*.

Figure 5B:
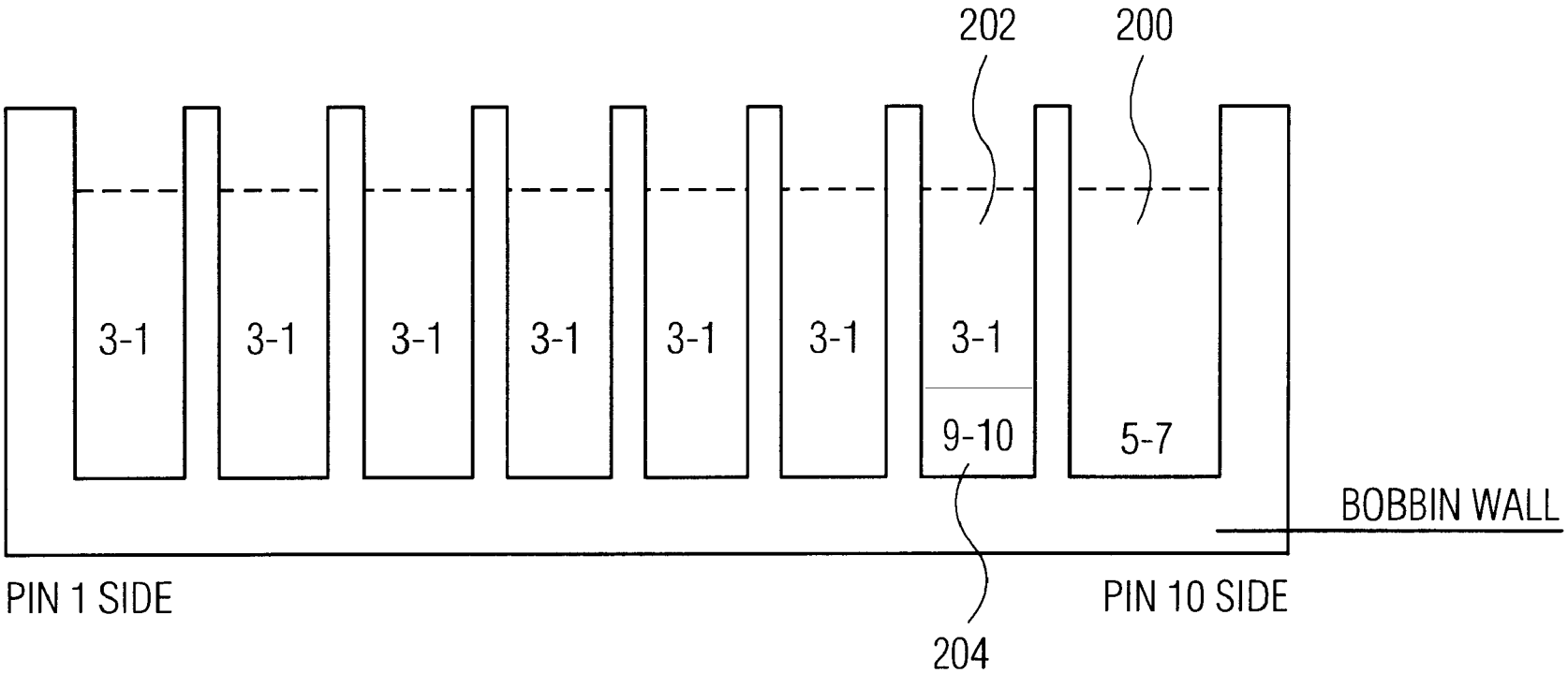
FIG. 5*b* is a drawing of the mechanical structure of a bobbin wound with the primary, secondary and sense windings.

Looking more closely at FIG. 5*b*, thin diameter Cold Cathode Fluorescent Lamps (CCFL), such as those used as LCD backlights, require a high voltage. In prior art CCFL lamps in order to minimize the voltage between turns of the transformer secondary, this winding is usually wound on a long bobbin with one section for the primary and several sections for the secondary somewhat similar to the inventive bobbin shown in FIG. 5*b*. Such a construction leads to a relatively high leakage inductance or equivalently relatively poor coupling between the windings. However, in the prior art the sensing winding is connected to the low voltage control circuitry and is normally wound in the same section as the primary winding. In the invention shown in FIG. 5*b*, the sense winding 9-10 (204) is placed in the low voltage section of the secondary winding 3-1 (202) underneath the winding. This low voltage section is the one that should be closest to the primary. The sense winding 9-10 (204) is coupled more tightly to the secondary than in the normal prior art case. This means that the sensed voltage will be a more accurate representation of the secondary voltage. When one of the outputs (lamps J1(124) or J2 (132)) is shorted, the sensed voltage from one of the third sense windings (142) or ( 144) will decrease more than when the winding is in the primary section (200). Of course, the sensed voltage will not decrease to zero, because there will still be magnetic flux that is coupled by the secondary winding (202) but not by the sense winding (204). The voltage across the sense winding will be the difference between the output voltage (zero) and that across the secondary leakage inductance. The sense winding can also be connected to the secondary winding in a tapped or autotransformer configuration.

Looking at the remaining blocks of FIGS. 2*b* and 2*c*, blocks 74,76 make up the start sequence logic 16 of FIG. 1. Block 74 is made up of Q4, C11, C12, D10 and R36 connected as shown in FIG. 2*b*. Block 76 is made up of logic circuit U8 manufactured by Philips Semiconductor, R47, R46, Q5, R49, D15, C32, C21,C31, R29, D14, D11 land M1 connected as shown in FIG. 2*c*.

The backlight ballast is dimmed with ON-OFF (PWM) dimming. Blocks 78 and 80 make up dimming logic 14 shown in FIG. 1. Block 78 is made up of logic circuit U3 manufactured by Philips Semiconductor, R50, R35, M3, Q3, R3, R4, D16, D4, C1, C13,C14, R17, R18 and D14, connected as shown in FIG. 2*b*. Dimming is achieved by stopping full power operation for variable intervals at a frequency of about 150–200 Hz. The logic circuitry of U3 takes a pulse width modulated signal (PWM)), DIM, from an external control device, i.e. control IC 18. When the "DIM" signal is low, the power stage oscillates, when it is high, the oscillation stops. The PWM signal must be synchronized to the power stage oscillation so that the switching stops the same way from cycle to cycle. Synchronization ensures that flicker in the display is minimized. The "LampOn" output of V3 goes low when DIM rises AND "G2in", the M2 gate drive output of the control integrated circuit 18, rises. LampOn goes high when the PWM signal falls, and oscillation resumes.

PWM control block 80 is made up of D5, M2 and R15 (shown in FIG. 2*b*). When the PWM "OFF" signal comes in to R15, instead of shutting down control integrated circuit 18, the oscillation is halted by injecting current from Q1 in block 80 into the CF pin of control integrated circuit 18. After injecting enough current, the control integrated circuit 18 is unable to discharge C8, and the control integrated circuit 18 oscillator stops with G2in high (shown in block 78). In block 78 the LampOn output is logically ANDed with G2in to create G2out, ensuring that the both gate drives are off when oscillation is blocked. Large power MOSFETS, Q2 and Q3 are used to boost the output current.

Integrated circuit U8 in block 76 (shown in FIG. 2*c*) and its surrounding components perform a power-on reset function. They ensure that the DIM signal does not stop oscillation while the power supply to the control integrated circuit 18 is rising and the lamps ignite. Only after a time delay is the dimming enabled. At that time PWM dimming can begin.

Integrated circuits U7 and U8 in blocks 70 and 76, respectively, contain the circuitry that allows the microprocessor board to enable or disable the backlight inverter. A 5 V ENABLE input from J3 is shifted to 12 V and delayed by the inverter of Q5 in block 76 and the following RC filter. A diode, D15 is used to reduce the delay to disable the inverter. The shifted and delayed enable signal turns on a p-channel MOSFET, M1, providing power to control integrated circuit 18.

While the preferred embodiments of the invention have been shown and described, numerous variations and alternative embodiments will occur to those skilled in the art. Accordingly, it is intended that the invention be limited only in terms of the appended claims.

We claim:

1. A lamp ballast for energizing a lamp comprising, a transformer providing an output voltage to said lamp, said transformer having a primary winding, a secondary winding, and a third sense winding, said third winding having an output which provides an indication of transformer output voltage, a reference voltage circuit for creating a reference voltage providing an indication of a non-short circuited lamp ballast condition, a comparator for comparing said reference voltage and said output of said third winding, said comparator providing an indication if said third winding output is below said reference thus indicating a short in said output of said lamp ballast.

2. The ballast of claim 1 in which said sense winding is wound with the secondary winding.

3. The ballast of claim 2 in which said secondary is wound on multiple sections of a bobbin with one section being a low voltage section, said sense winding being wound in said bobbin secondary low voltage section.

4. The ballast of claim 3 in which said sense winding is wound under said secondary in said bobbin secondary low voltage section.

5. The ballast of claim 4 having a dimming circuit during which time said lamp voltage is reduced substantially, said ballast further having a track and hold circuit which cooperates with the voltage of said sense winding at said comparator to hold the voltage of said sense winding at said comparator above said reference voltage so as to prevent an indication of a short in said lamp voltage.

6. The ballast of claim 5 in which voltage of said sense winding at said comparator is filtered with first and second filter resistors, said track and hold circuit having a first switch connected between said first and second filter resistors, respectively, and ground to hold the voltage of said sense winding at said comparator above said reference voltage so as to prevent an indication of a short in said lamp voltage.

7. The ballast of claim 6 having a power source to provide power at startup to said transformer including said sense winding, said sense winding voltage at said comparator gradually increasing during a preheat mode during startup, a preheat logic signal applying a low voltage to said reference voltage circuit during said preheat mode to prevent said reference voltage from exceeding said sense winding voltage to prevent a short circuit indication during preheat mode.

8. The ballast of claim 4 having a power source to provide power at startup to said transformer including said sense winding, said sense winding voltage at said comparator gradually increasing during a preheat mode during startup, a preheat logic signal applying a low voltage to said reference voltage circuit during said preheat mode to prevent said reference voltage from exceeding said sense winding voltage to prevent a short circuit indication during preheat mode.

9. A lamp ballast for energizing multiple lamps comprising, multiple transformers providing output voltages to said lamps, each said transformer having a primary winding, a secondary winding, and a third sense winding, said third winding of each transfomer having an output which provides an indication of transformer output voltage, a reference voltage circuit for creating a reference voltage providing an indication of a non-short circuited lamp ballast condition, multiple comparators for comparing said reference voltage and said output of each said third winding, each said comparator providing an indication if said third winding output is below said reference thus indicating a short in said output of said lamp ballast.

10. The ballast of claim 9 in which each said sense winding is wound with said secondary winding.

11. The ballast of claim 10 in which each said secondary is wound on multiple sections of a bobbin, with one section being a low voltage section, said sense winding being wound in said bobbin secondary low voltage section.

12. The ballast of claim 11 in which said sense winding in each said bobbin secondary low voltage section is wound under said secondary in each said bobbin secondary low voltage section.

13. The ballast of claim 12 having a dimming circuit during which time said lamp voltage is reduced substantially, said ballast further having multiple track and hold circuits which cooperates with the voltages of each said sense winding at said comparator to hold the voltage of said sense winding at said comparator above said reference voltage so as to prevent an indication of a short in said lamp voltage.

14. The ballast of claim 13 in which the voltage of each said sense winding at said comparators are filtered with first and second filter resistors, said track and hold circuits having first and second switches connected between said first and second filter resistors, respectively, and ground to hold the voltage of said sense windings at said comparators above said reference voltage so as to prevent an indication of a short in said lamp voltage.

15. The ballast of claim 14 having a power source to provide power at startup to said transformers including said sense windings, each said sense winding voltage at said respective comparators gradually increasing during a preheat mode during startup, a preheat logic signal applying a low voltage to said reference voltage circuit during said preheat mode to prevent said reference voltage from exceeding said sense winding voltages to prevent a short circuit indication during preheat mode.

16. The ballast of claim 13 having a power source to provide power at startup to said transformers including said sense windings, each said sense winding voltage at each said comparator gradually increasing during a preheat mode during startup, a preheat logic signal applying a low voltage to said reference voltage circuit during said preheat mode to prevent said reference voltage from exceeding said sense winding voltages to prevent a short circuit indication during preheat mode.

17. A lamp ballast for energizing a lamp, comprising, a transformer providing an output voltage to said lamp, said transformer having a primary winding, a secondary winding, and a third sense winding, said third winding having an output which provides an indication of transformer output voltage;

a reference voltage circuit for creating a reference voltage providing an indication of a non-short circuited lamp ballast condition;

a comparator for comparing said reference voltage and said output of said third winding, said comparator providing an indication if said third winding output is below said reference thus indicating a short in said output of said lamp ballast, wherein voltage of said sense winding at said comparator is filtered with first and second filter resistors; and a track and hold circuit having a first switch and a second switch connected between said first and second filter resistors, respectively, and ground to hold the voltage of said sense winding at said comparator above said reference voltage so as to prevent an indication of a short in said lamp voltage.

18. The ballast of claim 17, further comprising:

a dimming circuit during which time said lamp voltage is reduced substantially, wherein said track and hold circuit cooperates with the voltage of said sense winding at said comparator to hold the voltage of said sense winding at said comparator above said reference voltage so as to prevent an indication of a short in said lamp voltage.

19. The ballast of claim 17, further comprising:

a power source to provide power at startup to said transformer including said sense winding, said sense winding voltage at said comparator gradually increasing during a preheat mode during startup, a preheat logic signal applying a low voltage to said reference voltage circuit during said preheat mode to prevent said reference voltage from exceeding said sense winding voltage to prevent a short circuit indication during preheat mode.

20. The ballast of claim 18, further comprising:

a power source to provide power at startup to said transformer including said sense winding, said sense winding voltage at said comparator gradually increasing during a preheat mode during startup, a preheat logic signal applying a low voltage to said reference voltage circuit during said preheat mode to prevent said reference voltage from exceeding said sense winding voltage to prevent a short circuit indication during preheat mode.

* * * * *